US008118888B2

(12) United States Patent
Molter et al.

(10) Patent No.: US 8,118,888 B2
(45) Date of Patent: Feb. 21, 2012

(54) TREADMILL DECK SUPPORT

(75) Inventors: Daniel E. Molter, Elmhurst, IL (US); Yury Galperin, Northbrook, IL (US); Rachel L. A. Buckley, Aurora, IL (US); Juliette C. Daly, Chicago, IL (US)

(73) Assignee: Brunswick Corporation, Lake Forest, IL (US)

( * ) Notice: Subject to any disclaimer, the term of this patent is extended or adjusted under 35 U.S.C. 154(b) by 1540 days.

(21) Appl. No.: 11/182,686

(22) Filed: Jul. 15, 2005

(65) Prior Publication Data

US 2007/0015636 A1 Jan. 18, 2007

(51) Int. Cl.
*A63B 71/00* (2006.01)

(52) U.S. Cl. ..... 48/54; 482/51

(58) Field of Classification Search ..... 482/51, 482/54; 119/700
See application file for complete search history.

(56) References Cited

U.S. PATENT DOCUMENTS 3,689,066 A 9/1972 Hagen
3,709,197 A * 1/1973 Moseley ..... 119/700
4,350,336 A 9/1982 Hanford
4,616,822 A 10/1986 Trulaske et al.
4,844,449 A 7/1989 Truslaske et al.
5,279,528 A 1/1994 Dalebout et al.
5,441,468 A 8/1995 Deckers et al.
5,454,772 A 10/1995 Rodden
5,827,155 A 10/1998 Jensen et al.
5,976,061 A 11/1999 Moon et al.
5,993,358 A 11/1999 Gureghian et al.
6,053,848 A 4/2000 Eschenbach
6,095,951 A 8/2000 Skowronski et al.
6,508,746 B1 * 1/2003 Jacobs et al. ..... 482/71
6,623,407 B2 9/2003 Novaek et al.
6,821,230 B2 11/2004 Dalebout et al.
2003/0139261 A1 7/2003 Kuo
2004/0147372 A1 7/2004 Wang et al.
2004/0214693 A1 * 10/2004 Piaget et al. ..... 482/52
2005/0250622 A1 * 11/2005 Chang ..... 482/54

* cited by examiner

*Primary Examiner* — Glenn Richman
(74) *Attorney, Agent, or Firm* — Michael B. McMurry

(57) ABSTRACT

To support a deck of an exercise treadmill one or more arcuate leaf springs are used in a deck support structure. The leaf springs can be made of a single member of elastomeric material. An adjustment mechanism can be used to change the radius of the leaf springs in order to vary spring rates of the leaf springs. Where a number of different leaf springs are used, the adjustment mechanism can be used to adjust the spring rates of different springs independently.

19 Claims, 9 Drawing Sheets

TREADMILL DECK SUPPORT

FIELD OF THE INVENTION

The invention generally relates to exercise equipment, and more particularly to human operated exercise treadmills.

BACKGROUND OF THE INVENTION

Exercise treadmills are widely used for various purposes. Exercise treadmills are, for example, used for performing walking or running aerobic-type exercise while the user remains in a relatively stationary position, further, exercise treadmills are used for diagnostic and therapeutic purposes. For all of these purposes, the person on the exercise treadmill normally performs an exercise routine at a relatively steady and continuous level of physical activity. Examples of such treadmills are illustrated in U.S. Pat. Nos. 4,635,928, 4,659,074, 4,664,371, 4,334,676, 4,635,927, 4,643,418, 4,749,181, 4,614,337, 6,095,951 and 6,572,512.

Exercise treadmills typically have an endless running surface which is extended between and movable around two substantially parallel pulleys at each end of the treadmill. The running surface usually includes a belt made of a flexible material extended around the pulleys. The belt is normally driven by a motor rotating the front pulley. The speed of the motor is adjustable by the user through a set of user controls so that the level of exercise can be adjusted to simulate running or walking as desired.

The belt is typically supported by a deck or support surface beneath the upper surface of the belt. The deck is usually composed of wood or MDF, in order to provide the required support. In addition, a low-friction sheet or laminate is usually provided on the upper deck surface to reduce the friction between the deck and the belt. In most cases, decks are relatively rigid which can result in high impact loads on the user's feet, ankles and knees as the user's feet contact the belt and the deck. This is often perceived by users as being uncomfortable and further can result in unnecessary damage to joints as compared to running on a softer surface.

Because the typical treadmill has a very stiff, hard running surface and can become uncomfortable for extended periods of running, manufacturers have sought to make the running surface more resilient in an attempt to improve user comfort. U.S. Pat. Nos. 3,408,067, 4,350,336, 4,616,822, 4,844,449, 5,279,528, 5,441,468, 5,454,772 and 6,095,951 disclose examples of resilient deck supports on treadmills to reduce impact loads. While reducing impact loads, these approaches have certain disadvantages. In some cases due to long usage, the resilient material loses its resiliency over time and becomes less resilient. In other cases, where the resiliency or spring rate of the deck supports made of a resilient material is constant, the supports usually will not provide adequate support and comfort for users having different weights and running styles. Another approach using resilient supports having a variable spring rate, such as shown in U.S. Pat. No. 6,095,951 do not allow the user to adjust the deck to achieve an individual comfort level. By the same token where the location of resilient support members can be changed, as described in U.S. Pat. No. 4,350,336, the resiliency of the deck is uneven along its longitudinal surface.

Accordingly, the invention provides a deck support that supports a deck of a human operable exercise treadmill that includes at least one resilient member configured generally as an arched leaf spring secured between the deck and the treadmill frame. The invention can also include a second such leaf spring spaced laterally from the first leaf spring or can include two sets of such leaf springs spaced longitudinally along the length of the deck.

In one embodiment of the invention, an adjustment linkage is coupled to at least one of the leaf springs and is operable to manipulate a first radius of the leaf spring(s) to vary the spring rate of the leaf spring(s). The adjustment linkage can similarly be operable to manipulate the radius of other leaf springs to vary the spring rates of these leaf springs as well. Specifically, the adjustment linkage can be operable to increase at least one of the leaf spring radii to decrease the spring rates and operable to decrease the radii to increase the spring rate.

In one embodiment of the invention, the adjustment linkage includes a first pivot that is pivotally supported on the treadmill frame and is coupled to a first leaf spring. A first lever is coupled to the first pivot, induces rotation of the first pivot in a direction to increase the first radius and induces rotation of the first pivot in another direction to decrease the first radius. The adjustment linkage can further include a second pivot that is pivotally supported on the treadmill frame and is coupled to a second leaf spring. A second lever is coupled to the second pivot, induces rotation of the second pivot in a direction to increase the second radius and induces rotation of the second pivot in a second direction to decrease the second radius.

In another embodiment, the deck support further includes a locking mechanism that is coupled to the adjustment linkage. The locking mechanism maintains the first and second radii at first and second desired settings, respectively.

In a further embodiment, the deck support additionally includes a third leaf spring having a third surface upon which the forward portion of the deck rests. The adjustment linkage is also coupled to the third leaf spring and is operable to manipulate the radius of the leaf spring so as to vary the spring rates of the leaf springs. If a fourth leaf spring is present, the adjustment linkage can similarly be connected to it as well.

In yet another embodiment, the adjustment linkage includes a first pivot that is pivotally supported on the treadmill and coupled to the first leaf spring and a second pivot that is pivotally supported on the treadmill and coupled to the third leaf spring. A lever is then coupled to the first and second pivots to induce rotation of the first and second pivots in a direction to increase the leaf spring radii and similarly to induce rotation of the first and second pivots in the other direction to decrease the radii.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

The following description of the preferred embodiments is exemplary in nature and is not intended to limit the invention to the embodiments described herein.

Figure 1:
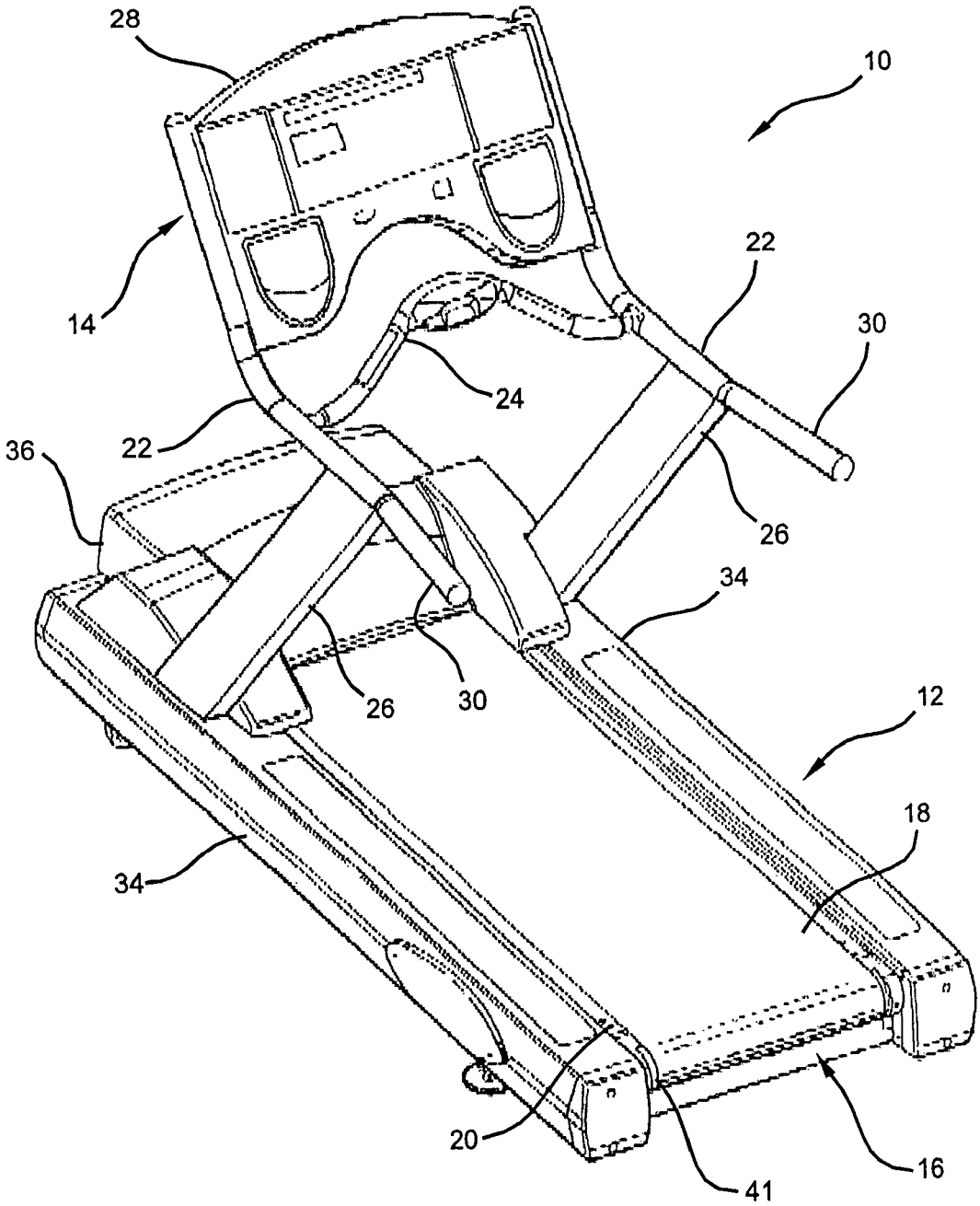
FIG. 1 is a perspective view of a treadmill that provides a representative environment for the invention.

FIG. 1 provides an example of a type of an exercise treadmill 10 configured for human use in which the invention can be implemented. This particular treadmill 10 is generally described in detail in U.S. Pat. No. 6,572,512, issued Jun. 3, 2003, the disclosure of which is expressly incorporated herein by reference. As is conventional in the treadmill art, the treadmill 10 includes a base 12 and a user support 14 extending therefrom. As explained in further detail below, the base 12 includes a frame 16 (see FIGS. 2 and 3) that rotatably supports a belt 18, the upper run of which moves along a deck 20. The deck 20 is at least partially resiliently supported on the frame 16 according to the invention. It is appreciated that the general construction of the treadmill 10 is merely exemplary in nature and the deck support of the present invention can be implemented in a wide variety of other exercise treadmill configurations.

The user support 14 includes a pair of side handrails 22 and a central handrail 24 that are supported above the base 12 by a pair of supports 26. The side handrails 22 and central handrail 24 provide lateral support for the user when running on the treadmill 10. A control panel 28 is supported between the side handrails 22 and enables the user to control operation of the treadmill 10. More specifically, the control panel 28 includes a plurality of input controls that enable the user to control such operating parameters as speed, incline angle, work-out program and the like. The control panel 28 further includes displays that provide visual indications of the work-out parameters, which can include calories burned, equivalent distance traveled, heart rate and the like.

The central handrail 24 is preferably curved in the general shape of an arc to provide an upward extension. This enables the user to grasp the central handrail 24 in a number of different vertical locations and also accommodates the knees of users running close to the front of the treadmill 10. The central handrail 24 can also include a pair of electrodes that are implemented to monitor the user's heart rate as generally taught in Leon et al, U.S. Pat. No. 5,365,934. The side handrails 22 are secured to the supports 26, which extend upward from the base 12. In this manner, the user support 14 is rigidly supported by the base 12.

Figure 2:
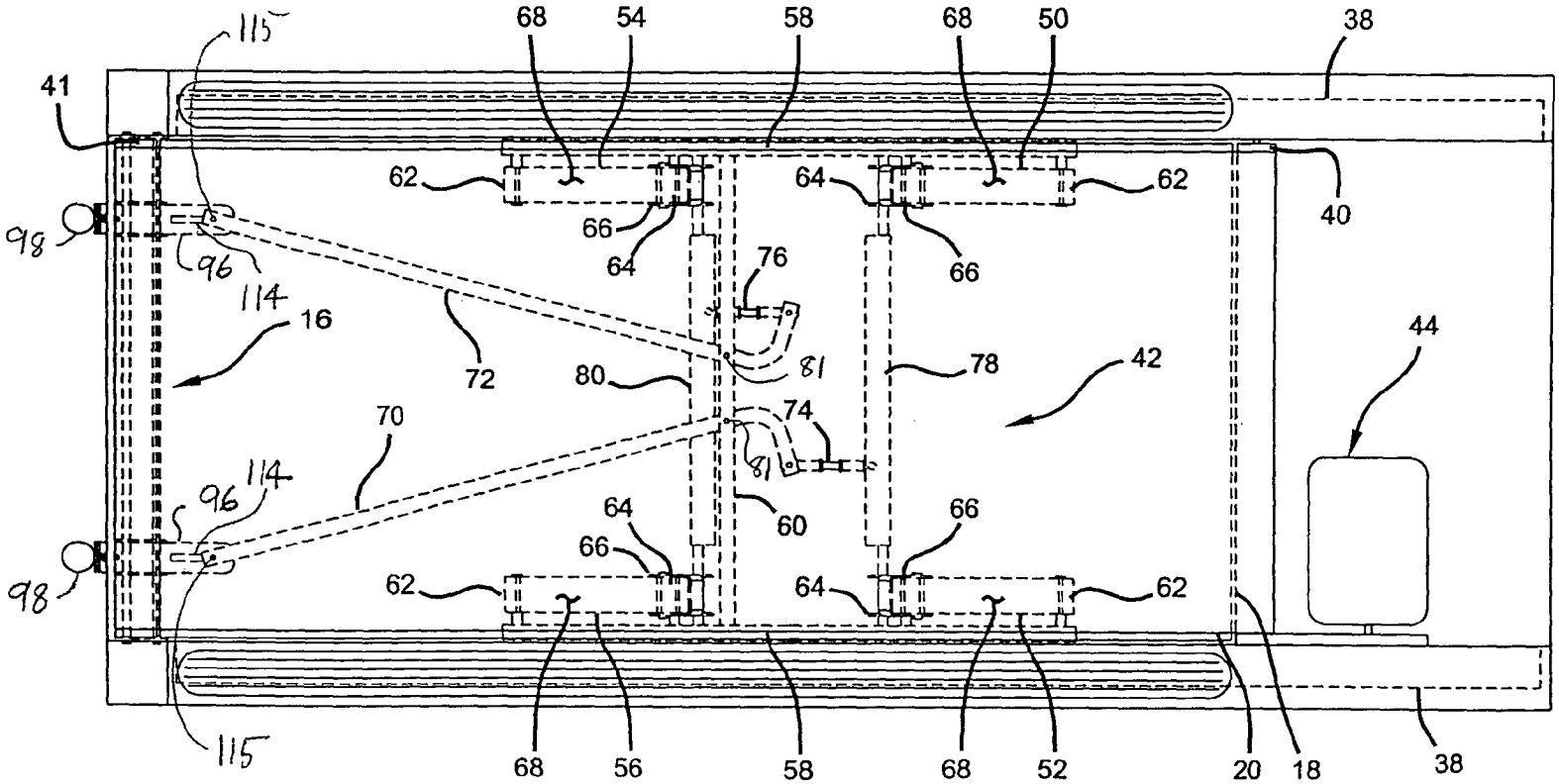
FIG. 2 is a partial cross-sectional plan view of the treadmill of FIG. 1 illustrating a deck support according to the invention.
Figure 3:
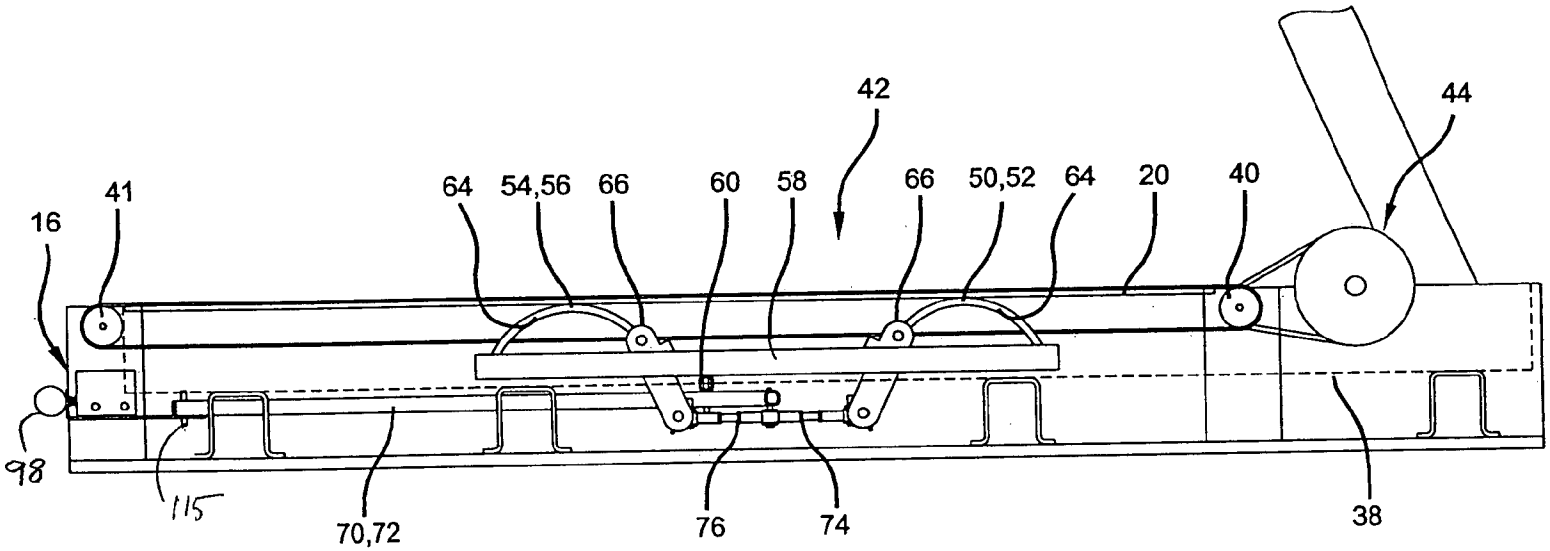
FIG. 3 is a cross-sectional side-view of the treadmill illustrating the deck support of FIG. 2.

Referring to FIGS. 1 through 3, the base 12 includes the frame 16 that is enclosed within a pair of frame housings 34 and a motor housing 36. The frame 16 includes a pair of longitudinal frame members 38 that provide support for a pair of pulleys 40 and 41 and the deck 20. A deck support structure generally indicated by 42 is located between the frame rails 38 wherein the deck 20 is resiliently supported on the frame 16 by the deck support structure 42. The belt 18 is rotatably mounted on the pulleys 40 and 41 for longitudinal movement and its upper run moves along the upper surface of the deck 20. The frame 16 further supports a drive unit including a motor 44 that is enclosed within the drive housing 36. The drive unit 44 is coupled with the forward pulley 40 to rotatably drive the belt 18. As is conventional in human operated treadmills, the speed of the drive unit 44 is regulated based on control signals input by the user via the control panel 28. It is appreciated that the illustrated drive unit 44 is merely exemplary in nature and the present invention can be implemented in treadmills that include other drive unit configurations.

Referring now to FIGS. 2 through 6, the preferred embodiment of deck support structure 42 is described in further detail. The deck support structure 42 serves to resiliently support the deck 20 on the frame 16 and in the preferred embodiment is adjustable to provide a range of deck stiffness. Also in the preferred embodiment, the deck support structure 42 includes a set of four adjustable springs 50, 52, 54 and 56 that are termed for the purposes of this description "leaf springs." Normally, the term leaf spring relates to long narrow springs consisting of several layers of metal springs bracketed together. However, here this term will include an elongated, arc shaped spring made of an elastic or elastomeric material. Specific advantages and characteristics of the leaf springs 50-56 are discussed below in connection with FIGS. 6A-C. It should be noted that more or less leaf springs of the type 52-56 can be used to support a treadmill deck depending on the size, cost and configuration of the treadmill. For example, in low cost treadmills as little as one, centrally located, leaf spring could provide suitable resilience for a deck. On the other hand, larger more expensive treadmills can use six or eight leaf springs of the type 50-56. In addition, for some treadmill applications, the leaf springs need not be adjustable. However, in the preferred embodiment to provide a balanced and consistent running surface, the four leaf springs 50-56 are arranged in a forward set including springs 50 and 52 and a rearward set including springs 54 and 56. In this case, the leaf springs 50-56 are supported by a pair of anchor rails 58. Each of the anchor rails 58 is rigidly fixed to the frame rails 38 and a cross-member 60 is secured to the anchor rails 58. A fixed end 62 of each of the leaf springs 50-56 is pivotally coupled to an adjacent anchor rail 58. To provide for adjustability of the leaf springs 50-56, an adjustable end 64 of each of the leaf springs 50-56 is pivotally coupled to a respective pivot member 66. Then each of pivot members 66 is rotatably coupled to a pin 67 which in turn is secured to the adjacent anchor rail 58 thereby permitting the pivot members 66 to rotate about an axis A. As a result, an upper surface of a central arc shaped portion 68 of each of the leaf springs 50-56 abuts the lower surface of the deck 20 and provides a resilient support for the deck 20. It should be noted that where adjustment of the leaf springs 50-56 is not desired, the adjustable end 64 can be secured to the deck support structure in a manner similar to the fixed end 62.

One of the characteristics of springs having the configuration of the leaf springs 50-56 is that they can be adjusted to provide varying degrees of deflection. As a result, the preferred embodiment of the invention also includes an adjustment mechanism that enables adjustment of each of the leaf springs 50-56. In this embodiment, the adjustment mechanism includes a pair of adjustment rods 70 and 72, a pair of linkages 74 and 76 and a pair of connecting members 78 and 80. The adjustment rods 70 and 72 are pivotally supported by a pair of pins 81 on the cross-member 60 thus providing a limited lateral rotation about respective axes B and C, and extend outwardly toward the rear portion of the frame 16, as explained in further detail below. Each of the connecting members 78 and 80 extends between and is pivotally coupled to two of the pivots 66. More specifically, the connecting member 78 is coupled to the pivots 66 of the forward set of leaf springs 50 and 52 and the connecting member 80 is coupled to the pivots 66 of the rearward set of leaf springs 54 and 56. The linkages 74 and 76 serve to connect the adjustment rods 70 and 72 with the connecting members 78 and 80 thereby providing a mechanism to adjust the leaf springs 50 and 56. The following is an illustration of the operation of this embodiment of an adjustment mechanism. First, the end of the adjustment rod 70 is moved laterally to the left by a user utilizing the arrangement described below in connection with FIGS. 8 and 9. This results in the other end of the adjustment rod 70 moving rearwardly thus causing the linkage 74 to move the connecting member 78 rearwardly resulting in pivot member 66 associated with the leaf springs 50 and 52 to rotate clockwise about axis A. Since adjustable ends 64 of the leaf springs 50 and 52 will move forward and the other ends 62 are fixed to the anchor rail 58, the radius of the leaf springs 50 and 52 will decrease as the pivot member 66 rotates about axis A thereby increasing the stiffness of these springs. In this manner, the stiffness of the leaf springs 50-56 can be adjusted. One of the advantages of this particular embodiment of the adjustment mechanism is that the forward leaf springs 50 and 52 can be adjusted by a user independently of the rearward leaf springs 54 and 56.

Figure 6A:
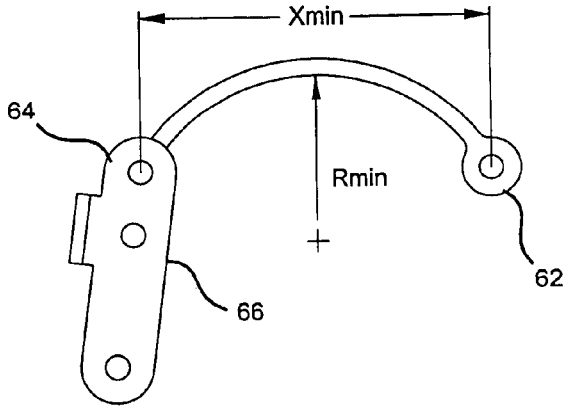
FIGS. 6A through 6C are side-views of an adjustable leaf spring used on the deck support of FIG. 2 shown in firm, medium and soft positions, respectively.
Figure 6B:
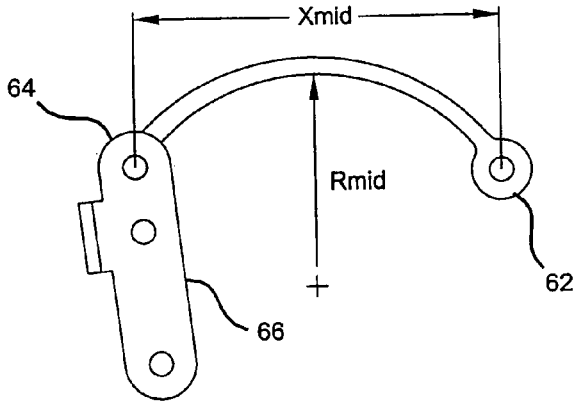
Figure 6C:
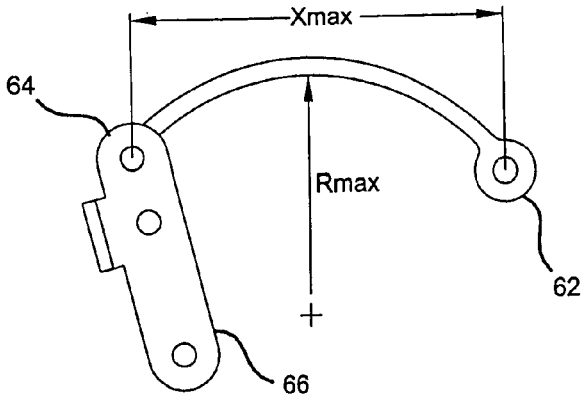
Figure 7:
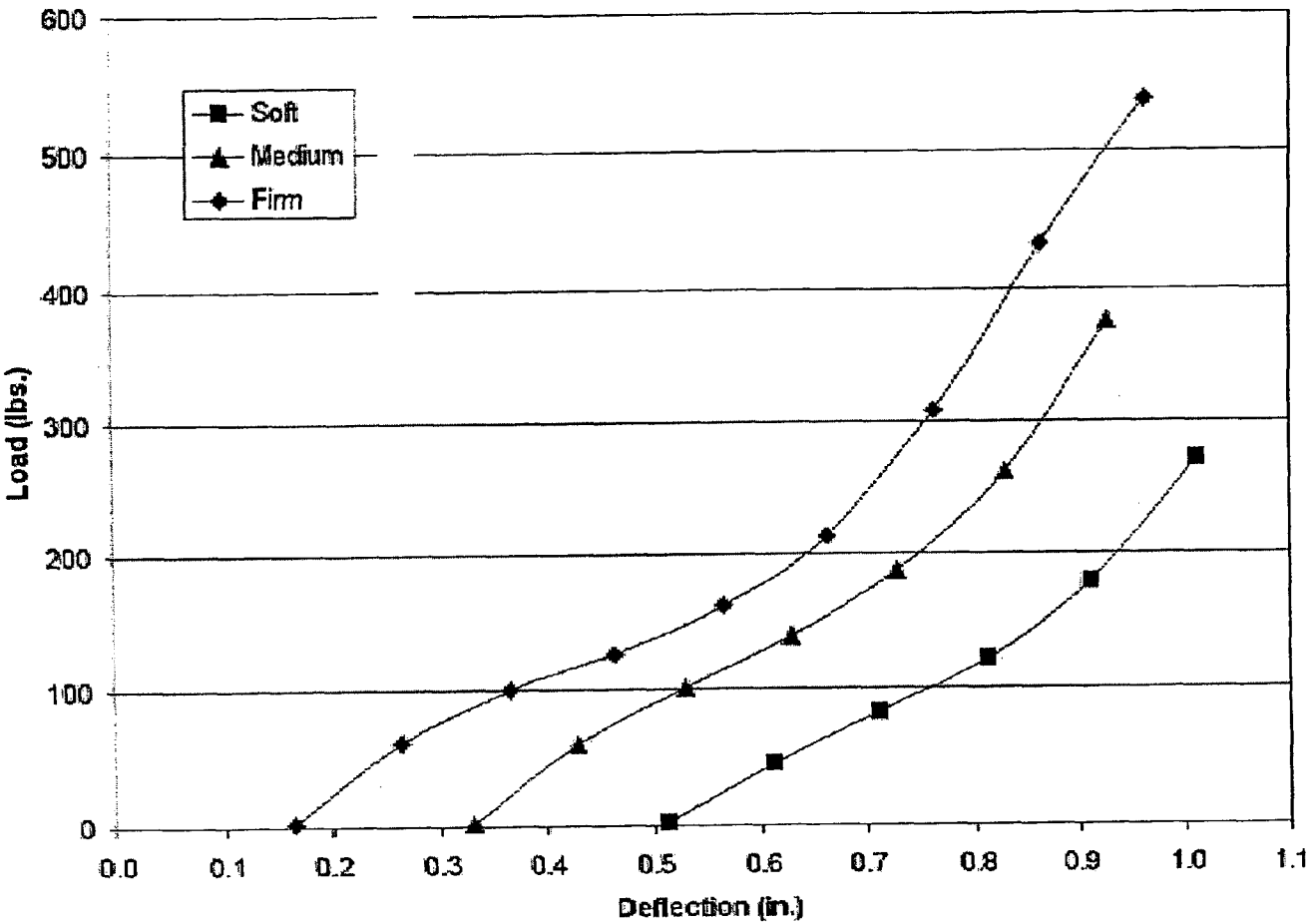
FIG. 7 is a graph illustrating deck load versus deck deflection for each of the firm, medium and soft positions of the leaf springs of FIGS. 6A-6C.

FIG. 7, in combination with FIGS. 6A, 6B and 6C, depicts the characteristics of the leaf springs 50-56 by providing a graph of the downward deflection in inches versus load in pounds for three different settings of the springs 50-56. First, it should be appreciated that elongated spring members having a generally arcuate configuration such as springs 50-56 will generally have a variable spring constant k, where k is defined in terms of load (e.g., lbs.) per unit of deflection (e.g., in.) A variable k will result in springs having a variable deflection rate. Using springs having a variable rate of compression to support the deck of a treadmill such as the deck 20 has a number of advantages including being able to accommodate runners having different weights and running styles because such decks will tend to deflect the same amount for users of different weights. Thus, even in an embodiment of a treadmill where, for example, both of the ends 62 and 64 of the leaf springs 50-56 are fixed directly to the frame 16, the deck 20 can have a variable deflection rate. Although the leaf springs according to the invention can be made of metal or other materials and can include more than one elongated arcuate member, preferably they are made of a single member of elastomeric material such as material used in TECSPA-K.RTM. resilient members available from Miner Elastomer Products of St. Charles, Ill. This particular product has suitable resilient characteristics for treadmill applications and additionally retains its resilient characteristics for an extensive amount of time.

Another feature of the invention is illustrated by the combination of springs shown in FIGS. 6A-C with the graphs in FIG. 7. That is, by using an adjustment mechanism such as the mechanism described above, the stiffness of each of the leaf springs 50-56 can be adjusted to provide different variable spring constants k and thus different variable spring rates. More specifically, a distance (X) between the adjustable end 64 and the fixed end 62 of the leaf springs 50-56 is changed in order to vary the radius (R) of the arc of the spring. When at a firm setting, X is at a minimum ($X_{MIN}$) providing a minimum radius ($R_{MIN}$) (see FIG. 6A). As a result, k is adjusted to a firm spring rate ($k_{FIRM}$). When at a medium setting, X is at a mid-value ($X_{MID}$) providing a mid-value radius ($R_{MID}$) (see FIG. 6B). As a result, k is adjusted to a medium spring rate ($k_{MED}$). When at a soft setting, X is at a maximum ($X_{MAX}$) providing a maximum radius ($R_{MAX}$) (see FIG. 6C). As a result, k is adjusted to a soft spring rate ($k_{SOFT}$). Although three settings (i.e., firm, medium and soft) are described in detail herein, it is appreciated that the deck support 42 can provide more or fewer settings.

FIG. 7 depicts deflection curves for each of the above-described settings. The firm curve provides generally less deflection for an equivalent load than either the soft curve or the medium curve. The medium curve generally provides more deflection for an equivalent load than the firm curve and less deflection for an equivalent load than the soft curve. The soft curve usually provides more deflection for an equivalent load than either the firm curve or the medium curve. For example, at an exemplary load of 100 lbs., the firm curve provides a deflection of approximately 0.35 in., the medium curve provides a deflection of approximately 0.53 in. and the soft curve provides a deflection of approximately 0.75 in.

Figure 8:
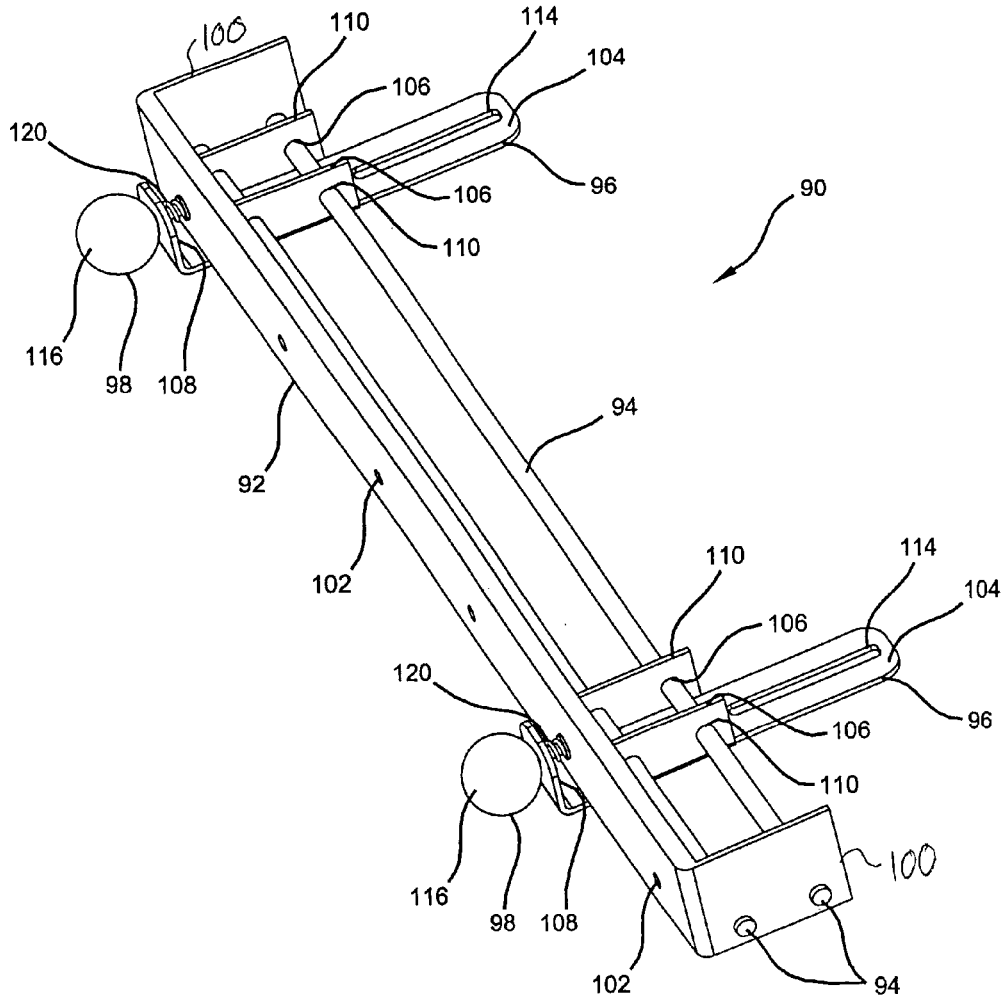
FIG. 8 is a perspective view of an exemplary adjustment mechanism of the deck support of FIG. 2.
Figure 9:
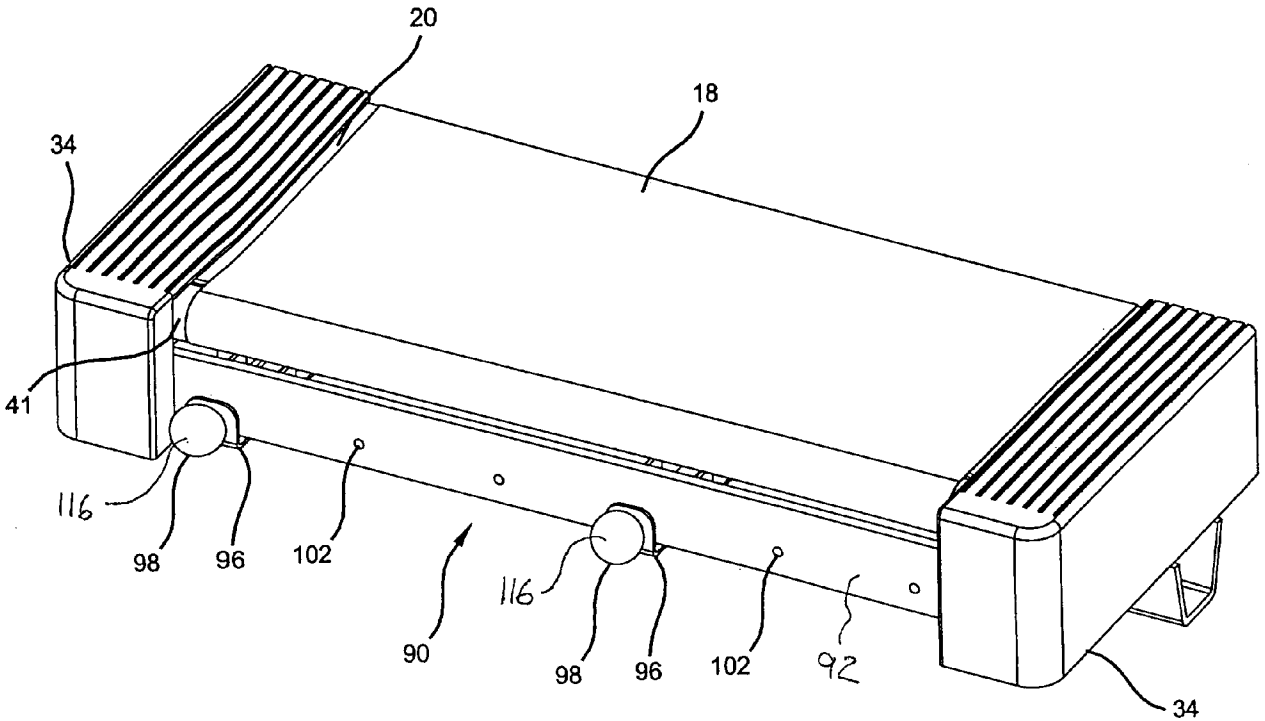
FIG. 9 is a perspective view of an end of the treadmill illustrating implementation of the adjustment mechanism of FIG. 8.

FIGS. 8 and 9 provide the preferred embodiment of a user interface 90 that can be used with the adjustment mechanism shown in FIGS. 2-5. In this arrangement, the user interface 90 serves to move the ends of the adjustment rods 70 and 72 so as to vary the setting of the leaf springs 50-56 between soft, medium or firm. The user interface 90 also enables each lever 70 and 72 to be locked in a position to maintain the setting of its corresponding leaf spring set 50-52 and 54-56. In this embodiment, the user interface 90 includes a lateral support member 92 secured to the frame 16 of the treadmill, a pair of transverse rods 94, a pair of adjustment lever receiving brackets 96 and a pair of locking pins 98. The rods 94 are secured to and extend between a pair of side portions 100 of the lateral support member 92 and the adjustment lever receiving brackets 96 are mounted on the rods 94 so that they can slide transversely on the rods 94. In addition, the adjustment lever receiving brackets 96 in this embodiment are locked in position along the rods 94 by the locking pins 98. As explained in further detail below, the locking pins 98 can be engaged with the apertures 102 formed in the lateral support member 92 in order to hold the adjustment lever receiving brackets 96 at a desired lateral position.

Figure 4:
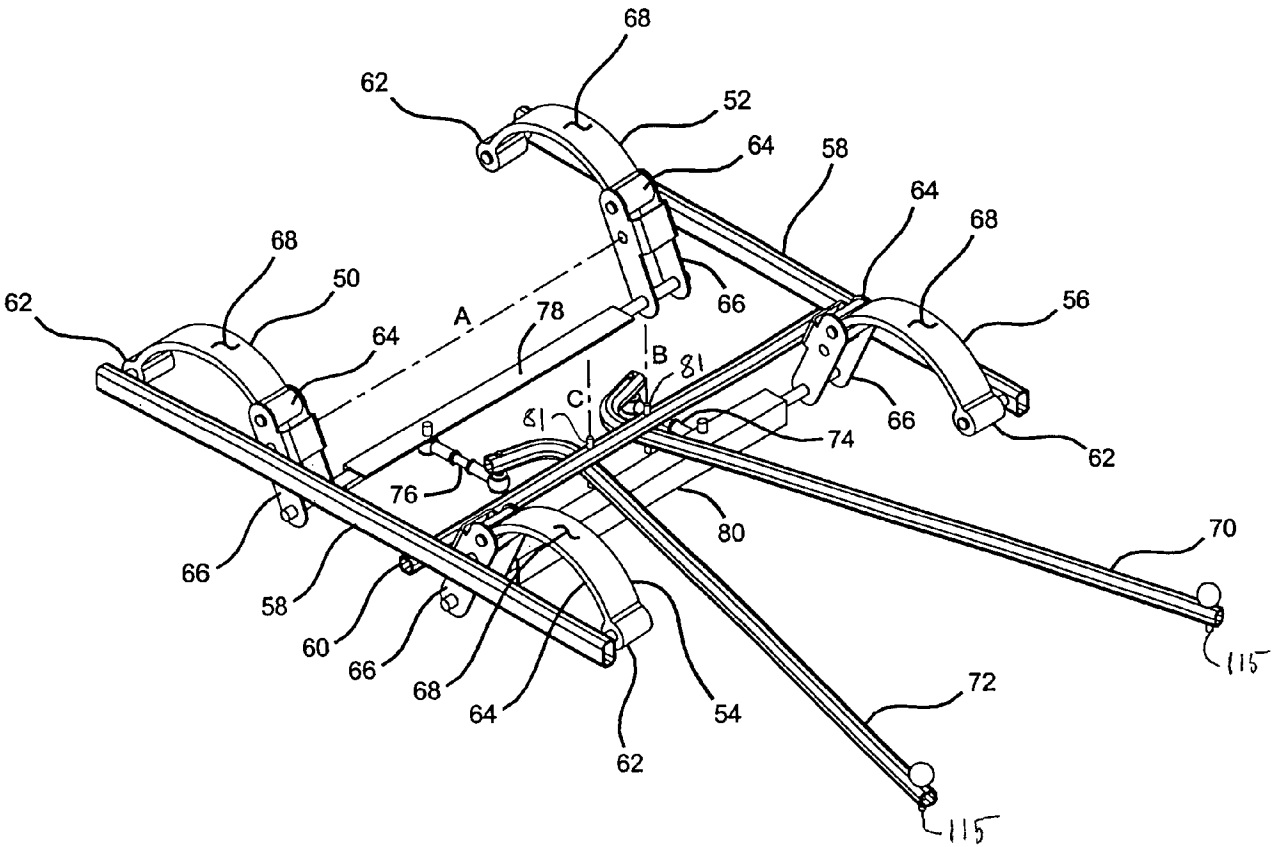
FIG. 4 is a perspective view of the deck support of FIG. 2.
Figure 5:
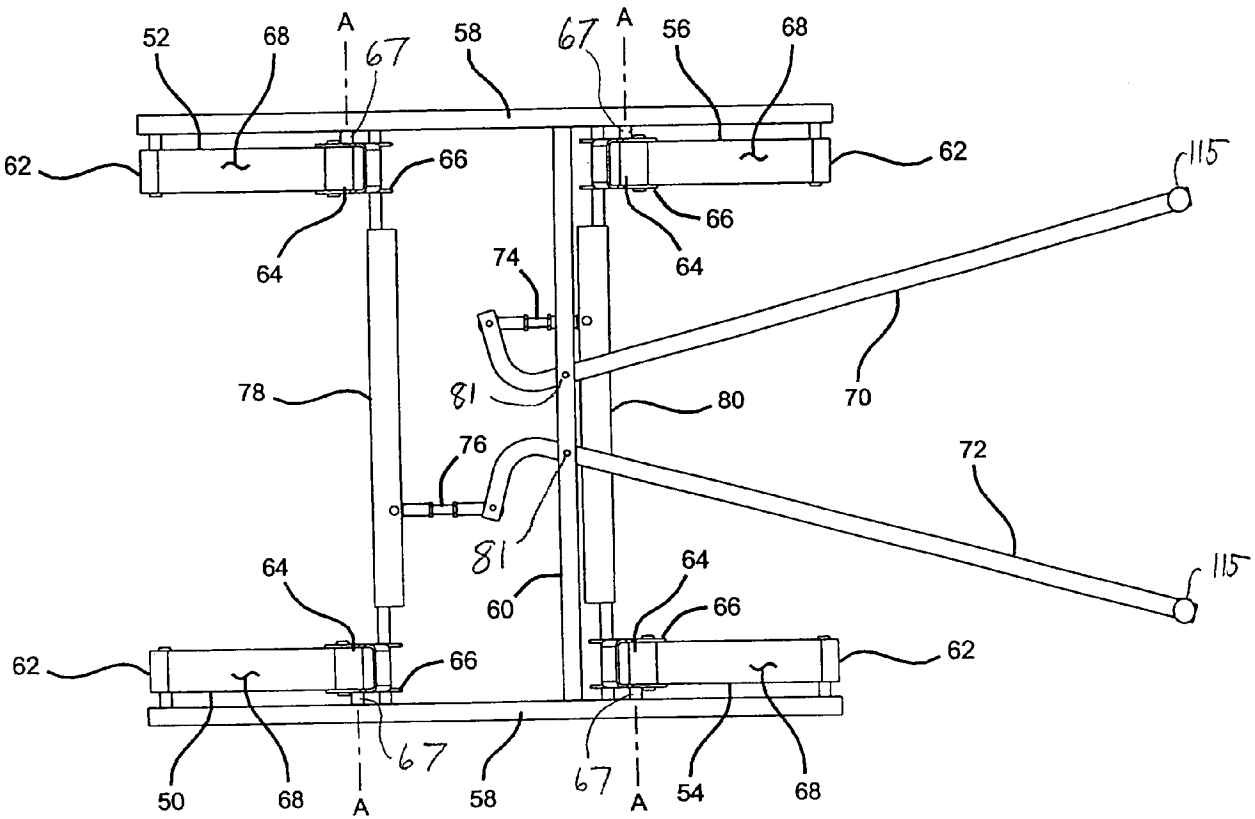
FIG. 5 is a plan view of the deck support of FIG. 2.

Each of the adjustment lever receiving brackets 96 is configured with a base portion 104, a pair of upwardly extending portions 106 having apertures to permit the adjustment lever receiving brackets 96 to slide laterally and a pin support portion 108 extending upwardly from the base portion 104 for receiving the locking pin 98. Each of the upwardly extending portions 106 includes a pair of apertures 110 which permit the adjustment lever receiving brackets 96 to slide on the rods 94. Bushings, not shown, can be implemented to improve the slidability of the adjustment lever receiving brackets 96 along the rods 94. Each base portion 104 further includes a slot 114, to which ends of the adjustment rods 70 and 72 are slidably attached by a pin 115 as shown in FIGS. 2-4. As a result, as the adjustment lever receiving brackets 96 move laterally along the rods 94, the pins 115 will move within the slots 114 thus causing the adjustment rods 70 and 72 to pivot about axes B and C. Each of the locking pins 98 include a knob 116 and extend through an aperture, not shown, in the pin support portions 108 of the adjustment lever receiving brackets 96. The locking pins 98 are each biased toward the lateral support member 92 by a spring 120 and operate to hold the adjustment lever receiving brackets 96 in position when inserted into the apertures 102.

To adjust the leaf springs 50-56 to a desired setting, the user pulls the knob 116 thus pulling the locking pin 98 out of engagement with the apertures 102 in the lateral support member 92. Then, the user can slide the adjustment lever receiving brackets 96 along the rods 94 until the locking pin 98 is aligned with a another one of the apertures 102, one that corresponds to the desired setting. By releasing the knob 116, the locking pin 98 will engage the other aperture 102 thereby preventing the adjustment lever receiving bracket 96 from moving along the rods 94. In this manner, a desired setting is maintained.

One advantage of this embodiment of an adjustment mechanism is that the setting of the forward set of leaf springs 50 and 52 can be different than the settings of the rearward set of leaf springs 54 and 56. More specifically, the adjustment rod 70 adjusts the setting of the forward set of leaf springs 50 and 52 and the adjustment rod 72 adjusts the setting of the rearward set of leaf springs 54 and 56. In this manner, additional flexibility is provided for the user to achieve a desired comfort level while using the treadmill 10. For example, a user can set the forward set of leaf springs 50 and 52 to firm, while the rearward set of leaf springs 54 and 56 are set to soft.

Further, although three settings, soft, medium and firm, have been described herein, it is appreciated that more or fewer settings can be achieved. For example, the lateral support member 92 can be configured with additional apertures 102 to provide for additional settings for the leaf springs 50-56. Although the deck support 42 described herein includes two adjustable leaf spring sets, 50 and 52 along with 54 and 56, as indicated above, the deck support 42 can be modified to include more or fewer adjustable leaf springs or leaf spring sets. In this manner, the deck support 42 can provide further flexibility in achieving user comfort during use of the treadmill 10. Additionally, it should be understood that the adjustment mechanism described above is merely the preferred embodiment. Other mechanisms can be used to adjust the radius R of leaf springs of the type 50-56. For example, mechanical actuators, electromechanical actuators or even hydraulic actuators operatively controlled by the user from the control panel 28 can be used to control settings of individual leaf springs or sets of leaf springs.

We claim:

1. An exercise treadmill, comprising:

a frame structure including, a pair of spaced apart longitudinal frame members for providing longitudinal structural support for said frame structure, and a motor support member;

a pair of rotatable pulleys secured to said frame, said pulleys being positioned substantially parallel to each other;

a motor for rotating a first one of said pulleys;

a deck member;

a belt secured over said pulleys so as to move in a longitudinal direction over said deck member when said first pulley is rotated;

a control panel secured to said frame structure and operatively connected to said motor wherein said control panel permits a user to control the speed of said belt; and a deck support structure including at least one arcuate leaf spring for supporting at least a portion of said deck on said frame structure wherein said leaf spring includes a first end, a central arc shaped portion and a second end wherein said first end is secured to said frame structure and a portion of said central portion abuts said deck.

2. The treadmill of claim 1 wherein said leaf spring is substantially comprised of an elastomeric material.

3. The treadmill of claim 1 wherein said second end is secured to said frame structure.

4. The treadmill of claim 1 wherein said deck support structure includes an adjustment mechanism for moving said second end of said leaf spring with respect to said first end in order to change the radius of the arc of said leaf spring.

5. The treadmill of claim 4 wherein said adjustment mechanism includes a pivot member pivotally attached to said frame structure and having a first end attached to said second end of said leaf spring effective to change the radius of the arc of said leaf spring as said pivot member rotates.

6. The treadmill of claim 1 including a first set of said leaf springs having at least two of said leaf springs wherein said leaf springs are spaced apart laterally from one another.

7. The treadmill of claim 6 additionally including a second set of said leaf springs having at least two of said leaf springs wherein said leaf springs are spaced apart laterally from one another and said second set is spaced longitudinally from said first set.

8. The treadmill of claim 6 including an adjustment mechanism for moving said second end with respect to said first end of each of said leaf springs in said first set in order to change the radius of the arc of said leaf springs in said first set.

9. The treadmill of claim 7 wherein said adjustment mechanism can additionally move said second end with respect to said first end of each of said leaf springs in said second set order to change the radius of the arc of said leaf springs in said second set and wherein said adjustment mechanism can change the radius of the arc of said first set of leaf springs independently from the radius of the arch of said second set of leaf springs.

10. An exercise treadmill, comprising:

a frame structure including, a pair of spaced apart longitudinal frame members for providing longitudinal structural support for said frame structure, and a motor support member;

a pair of rotatable pulleys secured to said frame, said pulleys being positioned substantially parallel to each other;

a motor for rotating a first one of said pulleys;

a deck member;

a belt secured over said pulleys so as to move in a longitudinal direction over said deck member when said first pulley is rotated;

a control panel secured to said frame structure and operatively connected to said motor wherein said control panel permits a user to control the speed of said belt; and a deck support structure including a plurality of resilient members configured as arcuate leaf springs having a central arc shaped portion abuting said deck for supporting at least a portion of said deck on said frame structure.

11. The treadmill of claim 10 wherein a first end and a second end of each member are secured to said frame structure.

12. The treadmill of claim 10 wherein said deck structure includes an adjustment mechanism coupled to said first end of at least a portion of said resilient members effective to move said first end with respect to said second end so as to change the radius of the arc of said resilient members.

13. The treadmill of claim 12 wherein said adjustment mechanism includes a locking mechanism for selectively retaining a plurality of predetermined radii of the arc of said resilient members.

14. The treadmill of claim 12 wherein said adjustment mechanism includes a pivot member for each of said first portion of said resilient members coupled to said first end of said resilient members and pivotally attached to said frame structure.

15. The treadmill of claim 14 wherein said adjustment mechanism includes an adjustment rod having a first end operatively connected to a second end of said pivot members effective to rotate said pivot members.

16. The treadmill of claim 15 wherein said adjustment mechanism includes a link member operatively connected between said first end of said adjustment rod and said second end of said pivot members.

17. The treadmill of claim 16 wherein said first portion of resilient members includes two of said resilient members and wherein said adjustment mechanism includes a connecting member pivotally connected to said second end of said pivot members and to said link member.

18. The treadmill of claim 17 wherein said adjustment rod is pivotally attached to said frame structure in order to permit limited horizontal rotation such that horizontal movement of a second end of said adjustment rod will cause said connecting member to move horizontally.

19. The treadmill of claim 18 wherein said adjustment mechanism includes a locking mechanism for selectively retaining second end of said adjustment rod in a plurality of predetermined positions.

* * * * *